US006025111A

United States Patent [19]

Schell et al.

[11] Patent Number: 6,025,111

[45] Date of Patent: Feb. 15, 2000

[54] STABLE MATTE FORMULATION FOR IMAGING ELEMENTS

[75] Inventors: Brian A. Schell, Webster; Mridula Nair, Penfield, both of N.Y.

[73] Assignee: Eastman Kodak Company, Rochester, N.Y.

[21] Appl. No.: 08/735,722

[22] Filed: Oct. 23, 1996

[51] Int. Cl.[7] ..... G03C 1/85; G03C 1/86; G03C 1/38; G03C 8/52

[52] U.S. Cl. ..... 430/212; 430/215; 430/527; 430/531; 430/637; 430/950; 430/961; 106/287.24; 106/287.26; 347/105; 428/411.1; 428/500; 524/500; 524/501; 524/503

[58] Field of Search ..... 430/531, 215, 430/637, 961, 950, 527, 212; 347/105; 524/501, 503, 500; 428/411.1, 500; 106/287.24, 287.26

[56] References Cited

U.S. PATENT DOCUMENTS

| | | | |
|---|---|---|---|
| 3,860,425 | 1/1975 | Ono et al. | 430/546 |
| 4,022,622 | 5/1977 | Timmerman et al. | 430/527 |
| 4,396,706 | 8/1983 | Ishij et al. | 430/523 |
| 4,814,321 | 3/1989 | Campbell | 503/227 |
| 4,855,219 | 8/1989 | Bagchi et al. | 430/527 |
| 4,943,520 | 7/1990 | Yoneyama et al. | 430/637 |
| 5,057,407 | 10/1991 | Okamura et al. | 430/531 |
| 5,135,844 | 8/1992 | Bagchi et al. | 430/637 |
| 5,198,408 | 3/1993 | Martin | 503/227 |
| 5,198,410 | 3/1993 | Martin | 503/227 |
| 5,252,535 | 10/1993 | Martin et al. | 503/227 |
| 5,378,577 | 1/1995 | Smith et al. | 430/531 |
| 5,393,650 | 2/1995 | Bagchi et al. | 430/531 |

*Primary Examiner*—Richard L. Schilling
*Attorney, Agent, or Firm*—Carl F. Ruoff

[57] ABSTRACT

The present invention describes an aqueous coating composition useful in an imaging element which includes polymeric matte beads, an ionic surfactant and a dispersant selected from the group of polymers represented by the generic structures shown below $$A—B \quad \text{I}$$

$$A—B—A \quad \text{II}$$

$$(AB)_xQ(BA)_z \quad \text{III}$$

wherein A comprises up to 150 repeat units of ethylene oxide, B comprises 3 to about 100 repeat units of a propylene oxide or higher alkylene oxide or combinations thereof, Q represents a multivalent linking group, x represents 1 or 2 and z represents 1 or 2.

The present invention describes an imaging element that includes a support, at least one image-forming layer, and an auxiliary layer of polymeric matte beads, an ionic antistatic agent, and a dispersant selected from the group of polymers represented by the generic structures shown below:

$$A—B \quad \text{I}$$

$$A—B—A \quad \text{II}$$

$$(AB)_xQ(BA)_z \quad \text{III}$$

wherein A is up to 150 repeat units of ethylene oxide, B is 3 to about 100 repeat units of a propylene oxide or higher alkylene oxide or combinations thereof, Q represents a multivalent linking group, x represents 1 or 2 and z represents 1 or 2. The present invention also describes an aqueous coating composition useful in an imaging element.

9 Claims, No Drawings

STABLE MATTE FORMULATION FOR IMAGING ELEMENTS

FIELD OF THE INVENTION

The present invention relates to an aqueous coating composition of polymeric matte particles and a dispersant useful in imaging elements. More particularly, the present invention relates to an imaging element including a layer of polymeric matte particles, an ionic antistatic agent and a dispersant.

BACKGROUND OF THE INVENTION

It is conventional to incorporate finely powdered grains or matting agents or particles into a layer of a photographic element to increase the surface roughness and achieve the following: (1) reduce blocking or reduce self-adhering of the material, (2) reduce friction and sticking of the material to itself and to manufacturing and processing devices, (3) improve the antistatic properties of the material, and (4) improve the vacuum adhesiveness of the material in contact exposure to prevent Newton's rings. The matting agents or matting particles are commonly very small particles of organic or inorganic polymeric materials such silicon dioxide, magnesium oxide, titanium dioxide, calcium carbonate, poly(methyl methacrylate), poly(vinyl toluene), poly(methyl methacrylate-co-methacrylic acid), and so on.

Particles used as matting agents are described in U.S. Pat. Nos. 4,855,219 and 4,022,622. Further, U.S. Pat. Nos. 4,396,706 and 5,057,407 provide matte particles and techniques in order to increase the adhesion of the particles to the photographic element during processing of the element. Further, U.S. Pat. No. 5,378,577 describes matte particles having a polymeric core material surrounded by a layer of colloidal inorganic particles. U.S. Pat. No. 5,198,408 describes the backing layer in a thermal dye transfer receiving element containing polymeric particles.

In a coating composition containing matte particles, a need exists for dispersants which will improve colloidal stability of the matte particles in the presence of ionic species, resulting in improved coating quality. The dispersant, ideally should prevent flocculation of the matte particles brought about by additives such as ionic antistatic agents.

PROBLEM TO BE SOLVED BY THE INVENTION

A problem inherent to certain coating compositions useful in imaging, for example, matting agents or particles is their tendency to flocculate particularly in the presence of increasing levels of ions prior to coating. The present invention provides a novel dispersant that can be used in aqueous compositions which decrease the tendency of matte particles in coating compositions to flocculate.

SUMMARY OF THE INVENTION

The present invention describes an aqueous coating composition useful in an imaging element which includes polymeric matte beads, an ionic antistatic agent and a dispersant selected from the group of polymers represented by the generic structures shown below $$A—B \qquad \text{I}$$

$$A—B—A \qquad \text{II}$$

$$(AB)_xQ(BA)_z \qquad \text{III}$$

wherein A comprises up to 150 repeat units of ethylene oxide, B comprises 3 to about 100 repeat units of a propylene oxide or higher alkylene oxide or combinations thereof, Q represents a multivalent linking group, x represents 1 or 2 and z represents 1 or 2.

The present invention also describes an imaging element that includes a support, at least one image-forming layer, and an auxiliary layer of polymeric matte beads, an ionic antistatic agent and a dispersant selected from the group of polymers represented by the generic structures shown below:

$$A—B \qquad \text{I}$$

$$A—B—A \qquad \text{II}$$

$$(AB)_xQ(BA)_z \qquad \text{III}$$

wherein A comprises up to 150 repeat units of ethylene oxide, B comprises 3 to about 100 repeat units of a propylene oxide or higher alkylene oxide or combinations thereof, Q represents a multivalent linking group, x represents 1 or 2 and z represents 1 or 2.

DETAILED DESCRIPTION OF THE INVENTION

The present invention provides a stable coating composition which comprises dispersed solid particles of a water-insoluble polymeric compound, i.e., a matting agent and a dispersing agent. The coating composition is useful as an auxiliary layer in an imaging element.

The general class of preferred dispersants are those which are water-soluble or dispersible and are represented by one of the following structures:

$$A—B \qquad \text{I}$$

$$A—B—A \qquad \text{II}$$

$$(AB)_xQ(BA)_z \qquad \text{III}$$

wherein:

A comprises up to 150 repeat units of ethylene oxide; B comprises 3 to about 100 repeat units of a propylene oxide or higher alkylene oxide or combinations thereof, Q represents a multivalent linking group such as ethylene diamine, and x represents 1 or 2 and z represents 1 or 2. Generally, dispersants useful in the present invention are well known in the art and some of them are commercially available. Typically the dispersant comprises water-soluble or dispersible block copolymers either linear or branched. The dispersants of the present invention comprise various poly(ethylene oxide) containing block copolymers at the ends of the chains. Examples of preferred dispersants and their structures are illustrated, for example, by the ethoxylated compounds as listed below.

Pluronic F108 available from BASF Corporation block copolymer of poly(ethylene oxide) and poly(propylene oxide).

PEO—PPO—PEO

Tetronic 908 available from BASF Corporation block copolymer of poly(ethylene oxide) and poly(propylene oxide).

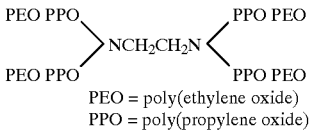

The preferred dispersants are amphipathic in nature. Such a dispersant comprises in its structure an oleophilic group (i.e. poly(propylene oxide)) of sufficient length to adsorb firmly to the surface of the dispersed particles and also comprises a poly(ethylene oxide) derived hydrophilic group of sufficient length to provide a large enough steric barrier to interparticle attraction. The dispersant may be nonionic or ionic in nature.

These amphipathic dispersants are generally block copolymers, either linear or branched and have segmented hydrophilic and oleophilic portions. The hydrophilic segment may or may not comprise ionic groups. The dispersants utilized in the present invention are believed to function essentially as steric stabilizers in protecting the dispersion against flocculation caused by ions in the dispersion medium.

The stabilized dispersion of this invention can be prepared by mixing together a block copolymer dispersant described above, and the matte particles followed by the addition of an ionic antistatic agent, binder and other components.

The resulting dispersion or coating composition of the present invention is applicable to any type of dye-receiving element used in thermal dye transfer or any image recording element that contains ink-receptive layers. The coating composition can also be used in the preparation of an imaging element comprising a support, such as paper or film, having coated thereon at least one imaging layer. The coating composition can be coated as an antistatic layer or other non-imaging layer, i.e., an auxiliary layer of the imaging element.

Such dye-receiving elements generally include a support bearing on one side thereof a dye-image receiving layer and on the other side thereof a backing layer. The backing layer material is chosen to (1) provide adequate friction to a thermal printer rubber pick roller to allow for removal of one receiver element at a time from a thermal printer receiver supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

Typical components of an antistatic backing layer generally include an antistatic material and a binder system such as an organo-clay binder, ionic polymers, poly(ethylene oxide) of poly(vinyl alcohol), submicron colloidal particles such as colloidal silica, coating aids, etc. Examples of binders are found in U.S. Pat. Nos. 4,814,321, 5,198,410, 5,252,535, the disclosures of which are hereby incorporated by reference. In a preferred embodiment of the invention, the binder in the backing layer comprises colloidal silica, polyethylene oxide and polyvinyl alcohol.

In a preferred embodiment fo the invention, the backing layer comprises a mixture of 10 to 80 weight percent polyvinyl alcohol as a polymeric binder, 0 to 15 weight percent polyethylene oxide as a polymeric binder, 10 to 40 weight percent submicron colloidal inorganic particles of a size from 0.01 to 0.05 $\mu$m, 1 to 35 weight percent polymeric matte particles of a size from 1 to 15 $\mu$m, and from 0.5 to 15 weight percent of an ionic antistatic agent, the polyvinyl alcohol comprising at least one half of the total amount of polymeric binder by weight.

The polyvinyl alcohol is preferably essentially fully hydrolyzed and of a molecular weight sufficient to provide a solution viscosity for coating of 10 to 50 cp. Other polymeric binders may be used with the polyvinyl alcohol polymeric binder. Preferably, the total amount of polymeric binder comprises from about 10 to about 80 weight percent of the backing layer, with at least about one-half, preferably about two-thirds, of the polymeric binder by weight being polyvinyl alcohol.

The submicron colloidal inorganic particles preferably comprise from about 10 to 40 weight percent, preferably about 15 to 30 weight percent of the backing layer mixture. While any submicron colloidal inorganic particles may be used, the particles are preferably water dispersible and less than 0.1 $\mu$m in size, and more preferably from about 0.01 to 0.05 $\mu$m in size. There may be used, for example, silica, alumina, titanium dioxide, barium sulfate, etc. In a preferred embodiment, silica particles are used.

The polymeric matte particles may comprise organic polymeric material, and preferably comprise from about 1 to 35 weight percent, more preferably about 5 to 25 weight percent, of the backing layer mixture. Inorganic particles are in general too hard and are believed to dig into the receiving elements in a supply stack, preventing such particles from effectively controlling the sliding friction between adjacent receiver elements. Matte particles well known in the art have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like. Particularly preferred polymeric matte particles are cross-linked polymers such as polystyrene cross-liked with divinylbenzene, and fluorinated hydrocarbon polymers. The polymeric particles are preferably from about 1 $\mu$m to about 15 $\mu$m in size, and particles from about 3 $\mu$m to about 12 $\mu$m in size are particularly preferred.

Examples of ionic compounds useful as antistatic agents in the backing layer include KCl, NaCl, LiCl, LiI, $LiNO_3$, NaI, KI, $KCF_3SO_3$, $Ca(CF_3SO_3)_2$, $Zn(BF_4)_2$, $LiBF_4$, $NaBF_4$, $C_4H_9SO_3K$, KSCN, LiSCN, NaSCN, $LiClO_4$, $KPF_6$ and the like, and conductive anionic or cationic polymer salts that are water dispersible or soluble such as poly(styrene sulfonate) salts and quaternary ammonium or phosphonium salt polymers. One skilled in the art can easily choose additional salts that cause an increased ion content of the coating composition given the compounds listed above. The antistatic agents comprise 0.5 to 15 weight percent of the backing layer.

The transparent support for the dye-receiving element of the inventon includes films of poly(ether sulfones(s)), polyimides, cellulose esters such as cellulose acetate, poly (vinyl alcohol-co-acetal(s)), poly(ethylene terephthalate), and poly(ethylene naphthalate). The support may be employed at any desired thickness, usually from about 10 $\mu$m to 1000 $\mu$m. Additional polymeric layers may be present between the support and the dye receiving layer. In addition, subbing layers may be used to improve adhesion of the dye image-receiving layer and backing layer to the support.

In the thermal dye-transfer transparency receivers of the invention, a total backing layer coverage of from 0.1 to about 0.6 g/m$^2$ is preferred. Backing layer coverages greater that 0.6 g/m$^2$ tend to have too much haze for tranparaency applications. For these backing layers, the total amount of polymeric binder preferably comprises from about 50 to 85 weight percent of the backing layer, and a total polymeric binder coverage of about 0.05 to 0.45 g/m$^2$ is preferred. An especially preferred polymer coverage is polyethylene oxide at about 0.02 g/m$^2$. The total polymer coverage is more preferably maintained below 0.25 g/m$^2$ to avoid haze.

The present invention is applicable to a transparent image-recording element that comprises a support, an ink-receptive layer and a backing layer in which the element is adapted for use in a printing process where liquid ink dots are applied to the ink-receptive layer. The backing layer is similar to the backing layer described for dye receiving elements used in thermal dye transfer imaging elements described above.

The present invention can be used in photographic elements such as simple black-and-white or monochrome elements comprising a support bearing a layer of light-sensitive silver halide emulsion or they can be multilayer and/or multicolor elements.

Color photographic elements typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 36544, September, 1994.

The light-sensitive silver halide emulsions employed in the photographic elements can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Methods of preparing imaging elements are well known in the art. For example, the preparation of single and multi imaging elements is described in *Research Disclosure* 308119, dated December, 1989, the disclosure which is incorporated herein by reference.

Typical photographic elements (materials, supports, etc. useful in the preparation thereof, in which the coating composition of this invention can be incorporated or disclosed in above-noted *Research Disclosure* 308119, incorporated herein by reference.

The support of image-forming elements of this invention can be coated with a magnetic recording layer as discussed in *Research Disclosure* 34309 of November, 1992, the disclosure of which is incorporated herein by reference.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published Dec. 1989, pages 1007 to 1008.

The present invention will now be described in detail with reference to examples; however, the present invention should not be limited to these examples.

The invention is illustrated by the following examples of its practice.

A poly(ethylene terphthalate) film coated with a subbing layer comprising a terpolymer of acrylonitrile, vinylidene chloride and acrylic acid was used as the support for the transparent imaging elements produced using the coating compositions described below.

EXAMPLE 1 (Comparison)

A 300 g batch of an aqueous coating composition was prepared by mixing 0.86 g of poly(ethylene-oxide) (PEO) in 120 g of deionized water at room temperature and gradually heating the contents to 95° C. and maintaining the solution at 95° C. for 30 minutes to dissolve the PEO, and then cooling to 70° C. The following ingredients were then added in the order described below while stirring the PEO solution:

28.8 g of a 10 weight percent aqueous solution of poly (vinylalcohol)(Elvanol 71-30, DuPont);

140.5 g deionized water;

0.12 g of a 70 weight percent aqueous solution of APG 225 Glycoside (nonionic surfactant, Henkel Corp);

0.03 g of a 22 weight percent aqueous solution of Triton X-200 (anionic surfactant, Rohm and Haas);

0.168 g of potassium chloride;

0.885 g of a 50 weight percent slurry of 3 micron poly(styrene-co-divinylbenzene) matte beads containing Dispex N40 (polycarboxylic acid sodium salt, Allied Colloids) diluted with 6.6 g deionized water. The poly(styrene-co-divinyl benzene) matte beads were prepared by providing an aqueous suspension of 1,800 g of water, 0.8 g of potassium dichromate, 11.9 g of poly(adipic acid-co-2-methylaminoethanol) and 180 g of Ludox TM. A monomer solution containing 82 g of styrene, 378 g of divinyl benzene and 12.6 g of VAZO 52 was added to the aqueous suspension and the resulting suspension was homogenized. 4000 g water and 40 g Dispex N40 were added to the homogenized suspension. The suspension was stirred at 50° C. for 16 hours. The temperature was increased to 85° C. for 4 hours to harden the particles of polystyrene crosslinked with divinylbenzene having an average size of 3 $\mu$m. The suspension was cooled and vacuum filtered. This procedure is described in U.S. Ser. No. 08/631,749.

2.0 g of Ludox AM (colloidal silica, DuPont).

This coating solution was examined microscopically immediately after its preparation and was observed to contain mostly individual matte particles. Shortly thereafter, pairs and larger aggregates of matte particles formed, and after 4 hours only large clumps of matte particles remained.

The coating composition of Example 1 was coated on the aforementioned support using a skim pan air knife at a coating concentration of 1 cc/ft$^2$. Similar matte particle aggregation was observed in the coated film as in the coating solution. Frequent filter changes and additions of make-up matte particles were needed to prepare long lengths of coated support, and the resultant coatings exhibited large variations in matte coverage over the length of each roll.

EXAMPLE 2 (Comparison)

A coating solution was prepared by the procedure used in Example 1 except that a 3 micron gelatin-containing poly (methylmethacrylate) matte as described in U.S. Pat. No. 5,563,226 was used. The matte particles were completely flocculated just after solution preparation.

EXAMPLE 3 (Invention)

An aqueous coating composition was prepared by mixing 0.025 g of Pluronic F108 poly(ethyleneoxide)-poly (propyleneoxide)-poly(ethyleneoxide) triblock co-polymer, (BASF Corp) in 120 g of deionized water. The temperature was raised to 95° C. with stirring. Next, 0.885 g of the matte from Example 1 diluted in 6.6 g of water was added and the contents held at 95° C. for 30 minutes before adding the remaining components as in Example 1.

Samples were withdrawn periodically and evaluated microscopically. The matte particles were observed to remain monodisperse for at least 2.5 days. The resultant solution was coated as in Example 1. The matte particles remained monodisperse in the final coating.

EXAMPLE 4 (Invention)

A matte slurry like that used in Example 1, but not containing Dispex, was stirred with Pluronic F108, and then used to prepare a coating solution by the method of Example 3. The matte particles were observed to remain stable and monodisperse for greater than 24 hours.

EXAMPLE 5 (Invention)

The same matte slurry used in Example 4 was treated with sodium hydroxide to dissolve the silica from the matte surface, then rinsed well to remove the alkali. This silica-free matte was used to prepare a coating solution by the method of Example 3. Samples were observed to remained fairly well dispersed.

EXAMPLES 6–11

Six more coating solutions were prepared by the method of Example 3 using the poly(ethylene oxide) based copolymers shown in Table 1 in place of Pluronic F108. The copolymers were added at a level of 5 weight percent of the matte. Samples were evaluated with a microscope after 16 hours. The results are shown in Table 1.

TABLE 1

| Example | Copolymer Description | Observations |
|---|---|---|
| 6 (Invention) | Tetronic 908 - block copolymer of poly(ethyleneoxide) and poly(propyleneoxide) (BASF Corp) | monodisperse |
| 7 (Comparison) | Dapral GE202 - partial ester of a branched carboxylic acid copolymer (Akzo) | flocculated |
| 8, 9, 10 (Comparisons) | Unithox D100, D110, and D150 - ethoxylated C24–50 n-alkane alcohols (Petrolite) | flocculated |
| 11 (Comparison) | Synfac 8210 - polyalkoxylated aryl-phenol (Milliken Chemical) | flocculated |

The above described examples show that the formulations that contain either Pluronic F108 or Tetronic T908 (Examples 3, 4, 5 and 6) provide stability for the matte particles compared to the examples (Examples 1, 2, 7, 8, 9, 10 and 11) formulated without these dispersants. Although all the described examples contain PEO based dispersants in the coating compositions, it is only the examples that contain block copolymers of PEO and the higher poly(alkylene oxide) (e.g. poly(propylene oxide)) that are effective in maintaining the colloidal stability of the matte particles in the coating composition.

The invention has been described in detail with particular reference to certain preferred embodiments thereof, but it will be understood that variations and modifications can be effected within the spirit and scope of the invention.

What is claimed is:

1. An aqueous coating composition useful in an imaging element comprising:

a polymeric binder;

an ionic antistatic agent;

polymeric matte beads; and a dispersant selected from the group of polymers represented by the generic structures shown below:

$$A—B \quad \text{I}$$

$$A—B—A \quad \text{II}$$

$$(AB)_xQ(BA)_z \quad \text{III}$$

wherein:

A consists of up to 150 repeat units of ethylene oxide; B is selected from the group consisting of 3 to about 100 repeat units of a propylene oxide and higher alkylene oxide, Q represents a multivalent linking group, x represents 1 or 2 and z represents 1 or 2.

2. The coating composition of claim 1 wherein said ionic antistatic agent is selected from the group consisting of KCl, NaCl, LiCl, LiI, $LiNO_3$, NaI, KI, $KCF_3SO_3$, $Ca(CF_3SO_3)_2$, $Zn(BF_4)_2$, $LiBF_4$, $NaBF_4$, $C_4H_9SO_3K$, KSCN, LiSCN, NaSCN, $LiClO_4$, $KPF_6$, conductive anionic water dispersible polymer salts, conductive cationic water dispersible polymer salts, quaternary ammonium salt polymers, and quaternary phosphonium salt polymers.

3. The coating composition of claim 1 further comprising colloidal inorganic particles having a size of less than 0.1 $\mu$m.

4. The coating composition of claim 1 wherein said polymeric binder comprises polyvinyl alcohol.

5. An imaging element comprising:

a support;

at least one image-forming layer; and an auxiliary layer comprising:

an ionic antistatic agent;

polymeric matte beads; and a dispersant selected from the group of polymers represented by the generic structures shown below:

$$A—B \quad \text{I}$$

$$A—B—A \quad \text{II}$$

$$(AB)_xQ(BA)_z \quad \text{III}$$

wherein:

A consists of up to 150 repeat units of ethylene oxide; B is selected from the group consisting of 3 to about 100 repeat units of a propylene oxide and higher alkylene oxide, Q represents a multivalent linking group, x represents 1 or 2 and z represents 1 or 2.

6. The imaging element of claim 5 wherein said ionic antistatic agent is selected from the group consisting of KCl, NaCl, LiCl, LiI, $LiNO_3$, NaI, KI, $KCF_3SO_3$, $Ca(CF_3SO_3)_2$, $Zn(BF_4)_2$, $LiBF_4$, $NaBF_4$, $C_4H_9SO_3K$, KSCN, LiSCN, NaSCN, $LiClO_4$, $KPF_6$, conductive anionic water dispersible polymer salts, conductive cationic water dispersible polymer salts, quaternary ammonium salt polymers, and quaternary phosphonium salt polymers.

7. The imaging element of claim 5 wherein said auxiliary layer further comprises colloidal inorganic particles having a size of less than 0.1 $\mu$m.

8. A dye receiving element for thermal dye transfer comprising:

a support;

a dye receiving layer; and a backing layer comprising:

an ionic antistatic agent;

polymeric matte beads; and a dispersant selected from the group of polymers represented by the generic structures shown below:

$$A—B \quad \text{I}$$

$$A—B—A \quad \text{II}$$

$$(AB)_xQ(BA)_z \quad \text{III}$$

wherein:

A consists of up to 150 repeat units of ethylene oxide; B is selected from the group consisting of 3 to about 100 repeat units of a propylene oxide and higher alkylene oxide, Q represents a multivalent linking group, x represents 1 or 2 and z represents 1 or 2.

9. An ink-jet receiving element comprising:

a support;

an ink-jet receiving layer; and a backing layer comprising:

an ionic antistatic agent;

polymeric matte beads; and a dispersant selected from the group of polymers represented by the generic structures shown below:

$$A—B \quad \text{I}$$

$$A—B—A \quad \text{II}$$

$$(AB)_xQ(BA)_z \quad \text{III}$$

wherein:

A consists of up to 150 repeat units of ethylene oxide; B is selected from the group consisting of 3 to about 100 repeat units of a propylene oxide and higher alkylene oxide, Q represents a multivalent linking group, x represents 1 or 2 and z represents 1 or 2.

* * * * *